US009175531B2

(12) United States Patent
Santos et al.

(10) Patent No.: US 9,175,531 B2
(45) Date of Patent: Nov. 3, 2015

(54) METHOD AND SYSTEM FOR IDENTIFYING A SELF-SUSTAINED INFLUX OF FORMATION FLUIDS INTO A WELLBORE

(71) Applicant: Safekick Ltd., Reading (GB)

(72) Inventors: Helio Santos, Reading (GB); Paul L. Sonnemann, The Woodlands, TX (US)

(73) Assignee: Safekick Ltd., Reading (GB)

( * ) Notice: Subject to any disclaimer, the term of this patent is extended or adjusted under 35 U.S.C. 154(b) by 0 days.

(21) Appl. No.: 14/060,541

(22) Filed: Oct. 22, 2013

(65) Prior Publication Data

US 2014/0110169 A1 Apr. 24, 2014

Related U.S. Application Data

(60) Provisional application No. 61/716,961, filed on Oct. 22, 2012.

(51) Int. Cl.

| | |
|---|---|
| ***E21B 21/08*** | (2006.01) |
| ***E21B 47/00*** | (2012.01) |
| ***E21B 21/10*** | (2006.01) |
| ***E21B 47/10*** | (2012.01) |

(52) U.S. Cl.

CPC ..... *E21B 21/08* (2013.01); *E21B 21/10* (2013.01); *E21B 47/00* (2013.01); *E21B 47/10* (2013.01)

(58) Field of Classification Search

USPC ..... 175/25, 38, 48

See application file for complete search history.

(56) References Cited

U.S. PATENT DOCUMENTS

| | | | |
|---|---|---|---|
| 3,552,502 | A | 1/1971 | Wilson |
| 7,044,237 | B2 | 5/2006 | Leuchtenberg |
| 7,278,496 | B2 | 10/2007 | Leuchtenberg |
| 7,367,411 | B2 | 5/2008 | Leuchtenberg |
| 2008/0060846 | A1 | 3/2008 | Belcher et al. |
| 2011/0214882 | A1 | 9/2011 | Santos |

FOREIGN PATENT DOCUMENTS

| | | | |
|---|---|---|---|
| GB | 2478119 | A | 8/2011 |

OTHER PUBLICATIONS

Santos et al., "Concepts, misconceptions about kick tolerance", (Nov./Dec. 2010) Drilling It Safely, found at http://www.drillingcontractor.org/concepts-misconceptions-aboutkick-tolerance.

PCT Search Report (PCT/US2013/066246), dated Sep. 29, 2014.

*Primary Examiner* — Giovanna C Wright

(74) *Attorney, Agent, or Firm* — Andrews Kurth LLP

(57) ABSTRACT

A method of identifying a self-sustained influx of formation fluids into a wellbore includes the steps of closing an annular shut-off device and diverting an annular return flow from the wellbore through a first flow rate measurement device, measuring a flow rate of said annular return flow, measuring an inlet flow rate of fluids entering the well through a second flow rate measurement device in a fluid injection line, and identifying a self-sustained influx of formation fluids if a non-decreasing measured annular return flow rate is greater than said measured inlet flow rate.

10 Claims, 9 Drawing Sheets

METHOD AND SYSTEM FOR IDENTIFYING A SELF-SUSTAINED INFLUX OF FORMATION FLUIDS INTO A WELLBORE

CROSS-REFERENCE TO RELATED APPLICATIONS

This application claims priority under 35 U.S.C. §119(e) to U.S. Provisional Application Ser. No. 61/716,961 filed Oct. 22, 2012, incorporated herein by reference in its entirety.

BACKGROUND

1. Field

Embodiments disclosed herein relate to a method and system for performing a flow check with a closed-to-atmosphere drilling system, resulting in improved accuracy compared to current open-to-atmosphere methods. Using methods disclosed herein, the presence of a self-sustained influx of formation fluids into a wellbore may be quickly and safely confirmed or ruled out.

2. Background

Well control techniques are used in oil and gas operations such as drilling, well workovers, and well completions to maintain fluid pressure at certain points in a wellbore above a formation pressure and prevent influx of formation fluids into the wellbore—known as "overbalanced" differential pressure. With the pumps on and fluid circulating, a combination of hydrostatic pressure, friction pressure and surface pressure may combine to maintain an overbalanced differential pressure in a wellbore. In the event that an "underbalanced" differential pressure comes to exist in the wellbore—where fluid pressure at certain points in the wellbore is less than the formation pressure—formation fluids may flow into the wellbore. The fluid influx will continue until either the fluid pressure in the wellbore is increased, or the formation pressure decreases. This type of fluid influx may be referred to as a "self-sustained" influx. The self-sustained influx should be stopped and the unwanted fluid safely removed from the wellbore before continuing with oil and gas operations. Notably, a self-sustained influx is often generally characterized in the industry as a "kick" along with other non-self-sustained influxes requiring different or no remedial action. As explained below, this exacerbates problems with accurately identifying a self-sustained influx with current open-to-atmosphere annulus fluid systems.

A flow check procedure is a method by which a driller may, upon suspicion or sign of a self-sustained influx, attempt to confirm whether such an event is indeed occurring before initiating well control techniques. A typical flow check procedure involves positioning the drill bit at a suitable position above the bottom of the wellbore/borehole, stopping rotation of the drillstring, and then stopping the mud pumps. The driller then checks to see if there is any flow returning from the well annulus (i.e., whether the well is "flowing") with the pumps off. If the well is flowing with the pumps off, the driller may conclude that some type of influx is entering the wellbore.

Conventional flow check procedures today are performed entirely with the BOP open, i.e., with an open-to-atmosphere annulus fluid system. Very often, using an open-to-atmosphere system is inadequate for the rig crew to accurately and quickly come to a conclusion as to whether a self-sustained influx is indeed happening or not due to a variety of other benign causes for such a perceived influx. For example, on floating rigs, relatively small yet significant self-sustained influxes may be difficult to observe because the conventional flow check procedure may be affected by rig motion and heave effects. Additionally, in some situations there may be outflow from the well that continues after the mud pumps are turned off due to thermal effects, well decompression, or flow back from fractures filled previously in (i.e., generally known as "ballooning"). Even though these conditions may cause outflow from the well, in such cases the flow is generally not due to a self-sustained influx of formation fluids into the wellbore. Therefore, they do not constitute kicks that might otherwise require precise control or response using well control procedures.

Moreover, flow check procedures take time that is often prescribed by procedure (e.g., requiring a minimum of 10, 15, or 30 minutes). Drillers may hesitate to risk stopping drilling operations for such periods until/unless clear justification exists. And worse yet, a driller who has had the experience of stopping to perform a flow check procedure only to find no self-sustained influx existed may be less likely to quickly do so again—even if new circumstances justify it—if the earlier flow check resulted in delay, costs or operational problems that could otherwise have been avoided by not performing the flow check.

Currently, the industry is ill-informed, prior to shutting in a well, to properly and accurately detect and distinguish between self-sustained influxes requiring well control techniques and temporary influxes that do not. Instead, the industry prefers to deal with all potential influxes in a "one size fits all" manner. This leads to a multitude of costly and inefficient false alarms and misleading information.

3. Identification of the Objects of the Invention

A primary object of the invention is to provide a method of quickly and accurately identifying a self-sustained influx of fluids into a wellbore, such as prior to initiating well control techniques.

It is another object of the invention to provide a method of accurately ruling out the presence of a self-sustained influx of fluids into said wellbore.

Another object of the invention is to provide a system for identifying a self-sustained influx of fluids into a wellbore.

SUMMARY

Methods and a system for identifying, confirming or ruling out the existence of a self-sustained fluid influx from a formation into a wellbore are disclosed. One or more embodiments disclose a system including a flow rate measurement device disposed in an annular return line of a wellbore for measuring an annular return flow rate. In other embodiments, the system may include a flow control device disposed either upstream or downstream from the flow rate measurement device in the annular return line. For example, the flow control device may be an automatic flow control device controlled by sensors and software. The flow rate measurement device may be located on the annular return line from a drilling rig's existing flow control device manifold while the sensors measure drilling parameters elsewhere in the system. The software in a computer acquires drilling parameters, ideally surface and downhole variables when available from system sensors, and performs calculations based on received sensor inputs to detect a possibility that a self-sustained influx is happening or might happen soon. When the situation reaches a stage that a procedure to confirm or rule out the presence of such an influx would be recommended, a computer may display a message indicating that such procedure should be initiated. The computer provides messages to a driller's console prompting a driller to follow the instructions based on the operation being conducted.

One such message may be to stop the drillstring rotation and to lift the drillstring off the bottom of the wellbore. In certain embodiments, the drillstring may continue rotating at the bottom of the wellbore. When those actions are completed by the driller, the software acts to close an annular shut-off device. Closure of the annular shut-off device may be done automatically or manually. After the annular shut-off device has been closed, annular flow return is directed through the flow control device, if present, and the flow rate measurement device. The mud pumps may continue running at a normal rate, followed by incremental reduction in pump speed, if needed, during various phases of the procedure. Ultimately, mud pumps may be stopped. Annular flow return rate is monitored and measured to confirm whether or not a self-sustained influx is occurring. If the presence of a self-sustained influx is confirmed, the software may partially close the flow control device until flow out equals flow in, in case the mud pumps are on, or completely close the flow control device if the pumps are off. If a flow control device is not present, the software may send a message to the driller alerting of the presence of a self-sustained influx. If the presence of a self-sustained influx is not confirmed with the pumps on, the system may instruct the driller to reduce the speed of the pumps, or completely shut the pumps off. If annular return flow rate reaches zero with the pumps off, the presence of a self-sustained influx is then ruled out, and the system instructs the driller to open the annular shut-off device and resume normal drilling activity.

BRIEF DESCRIPTION OF THE DRAWINGS

The invention is illustrated in the accompanying drawings wherein.

DETAILED DESCRIPTION

Figure 1:
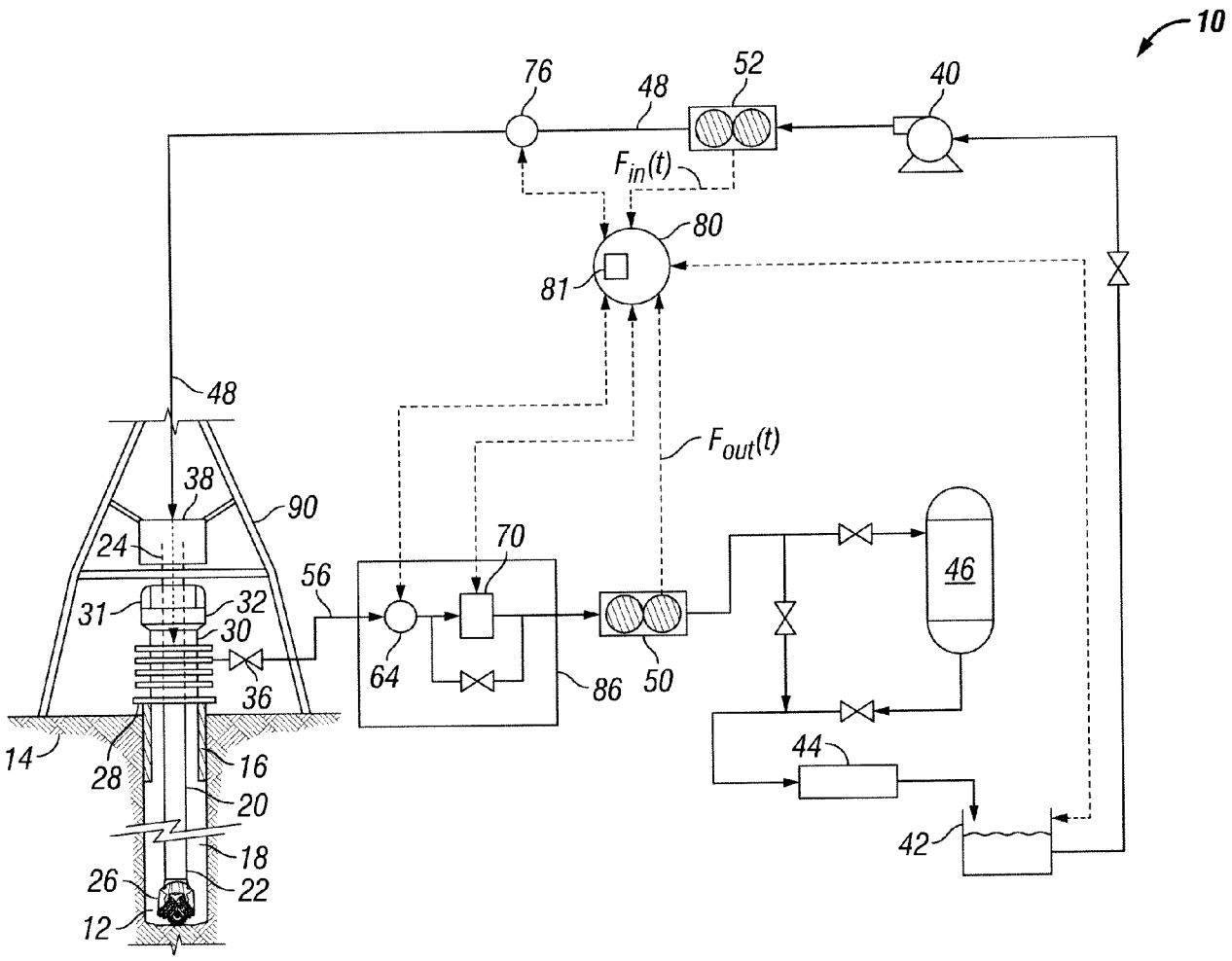
FIG. 1 illustrates a schematic view of an implementation of the system including a flow rate measurement device and flow control device for identifying a self-sustained influx.

FIG. 1 illustrates a system 10 that includes a tubular drillstring 20 suspended from a drilling rig 90. The drillstring 20 has a lower end 22 which extends downwardly through a BOP stack 30 and into borehole/well bore 12 in a formation 14. A drill bit 26 is attached to the lower end 22 of drillstring 20. A drillstring driver or turning device 38, comprising either a rotary drive system (not shown) or a top drive system 38, is operatively coupled to an upper end 24 of the drillstring 20 for turning or rotating the drillstring 20 along with drill bit 26 in the borehole 12. A conventional surface fluid/mud pump 40 pumps fluid from a surface fluid reservoir 42 through a fluid injection line 48, through the upper end 24 of drillstring 20, down the interior of drillstring 20, through drill bit 26 and into a borehole annulus 18. The borehole annulus 18 is created through the action of turning drillstring 20 and attached drill bit 26 in borehole 12 and is defined as the annular space between the interior/inner wall or diameter of the borehole 12 and the exterior/outer surface or diameter of the drillstring 20.

A conventional BOP stack 30 is coupled to well casing 16 via a wellhead connecter 28. Typically, the BOP stack 30 includes one or more pipe rams, one or more shear rams, and one or more annular BOPs 32. The BOP stack 30 may further include one or more additional annular shut-off devices 31 for use with flow check procedures and the system described herein. Alternatively, the one or more additional annular shut-off devices 31 may be separate from the BOP stack 30. When drilling is stopped (i.e., the drillstring driver 38 is no longer turning the drillstring 20 and drill bit 26), the one or more conventional annular BOPs 32 may be closed to effectively close the borehole annulus 18/well bore 12 from the atmosphere.

Referring still to FIG. 1, a flow control device line 56 is coupled between the conventional BOP stack 30 via flow control device line valve 36 and the surface fluid reservoir 42 via rig well control flow control device manifold 86. The rig well control flow control device manifold 86 includes a flow control device 70, such as a choke, disposed in the flow control device line 56. The flow control device 70 controls flow rate through the flow control device line 56 thereby controlling pressure upstream of the flow control device 70 and thus, backpressure to the well bore annulus 18 while the BOP 32 is closed. A mud-gas separator 46 and a shale shaker 44 are also preferably fluidly coupled to the flow control device line 56 and are positioned between the flow control device 70 and surface fluid reservoir 42. Thus, when flow control device line valve 36 and flow control device 70 are opened after the BOP 32 is closed, fluid from the borehole annulus 18 is permitted to flow up through BOP stack 30, through flow control device line valve 36, through flow control device line 56, through rig well control flow control device manifold 86, through mud-gas separator 46, through shale shaker 44 and into surface fluid reservoir 42.

As shown in FIG. 1, an outlet fluid flow rate measurement device 50, such as a volume or mass flow rate meter, is preferably used to measure the fluid flow rate out of the well bore 12 while the conventional blow-out preventer 32 is closed. Such fluid flow rate measurement device 50 is preferably a Coriolis flow rate meter, an ultrasonic flow rate meter, a magnetic flow rate meter or a laser-based optical flow rate meter, but may be any suitable type known to those skilled in the art. The outlet fluid flow rate measurement device 50 is arranged and designed to generate a signal $F_{out}(t)$, which is representative of actual annular return flow rate out of the well bore 12 through the flow control device line 56 as a function of time (t). The outlet fluid flow rate measurement device 50 transmits the signal $F_{out}(t)$, preferably in real time, to the central control unit 80, which receives and processes the signal. The outlet fluid flow rate measurement device 50 is preferably disposed in the flow control device line 56 between the flow control device 70 and the rig mud gas separator 46. However, the outlet fluid flow rate measurement device 50 may alternatively be disposed in the flow control device line 56 upstream of the flow control device 70 (i.e., between the well bore annulus 18 and the flow control device 70).

As shown in FIG. 1, an inlet pressure measurement device 76, such as a pressure sensor, is disposed in the fluid injection line 48. However, the inlet pressure sensor 76 could alternatively be disposed elsewhere in the fluid injection line 48, but preferably in close proximity to the inlet flow rate measurement device 52. The inlet pressure measurement device 76 is arranged and designed to generate signal $P_{in}(t)$, which is representative of the pressure in the fluid injection line 48 (i.e., the standpipe pressure) as a function of time (t). The inlet pressure measurement device 76 transmits signal $P_{in}(t)$, preferably in real time, to the central control unit 80, which receives and processes the signal.

An outlet pressure measurement device 64, such as a pressure sensor, is disposed in the choke line 56 preferably in proximity to the rig well control choke manifold 86 and upstream of the flow control device 70. The outlet pressure measurement device 64 is arranged and designed to generate a signal $P_{out}(t)$, which is representative of the pressure in the choke line 56 as a function of time (t). When the outlet pressure sensor 64 is disposed upstream of the flow control device 70, the pressure sensor measures pressure representative of the casing pressure (or the choke manifold pressure on floating rigs). The outlet pressure measurement device 64 transmits the signal $P_{out}(t)$ in real time to the central control unit 80, which receives and processes the signal.

Figure 2A:
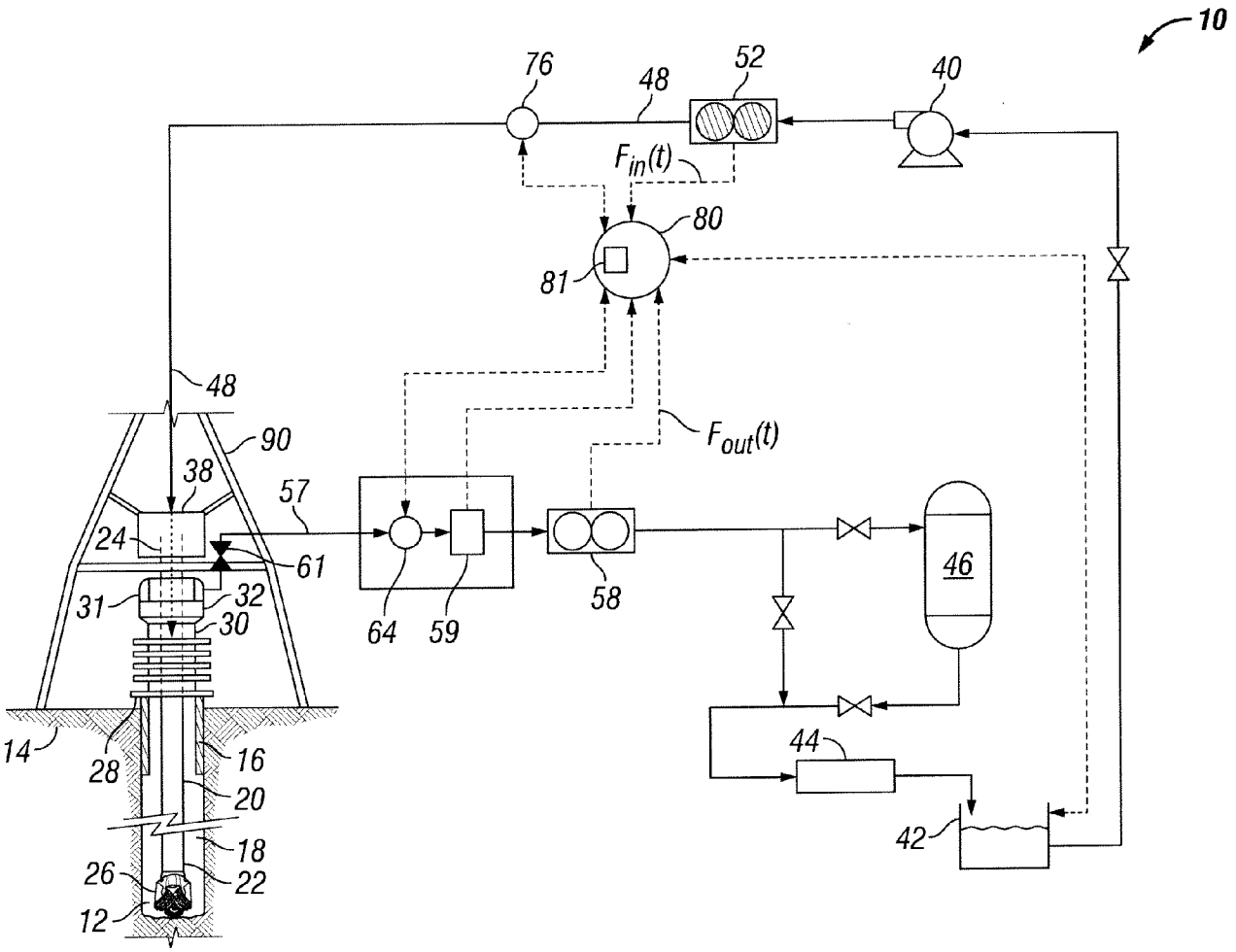
FIG. 2A illustrates a schematic view of an implementation of the system including a flow rate measurement device and flow control device for identifying a self-sustained influx.
Figure 2B:
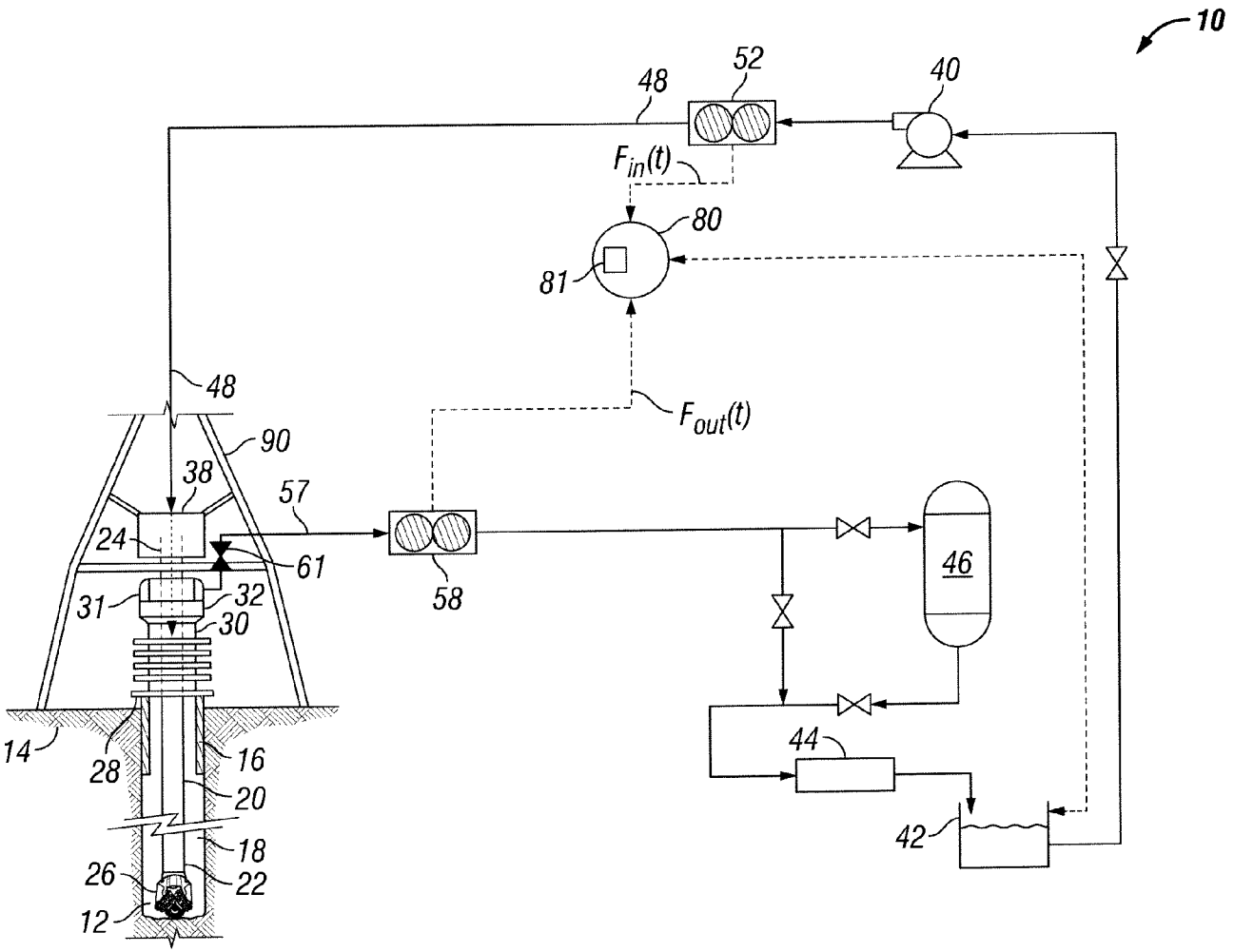
FIG. 2B illustrates a schematic view of an implementation of the system including a flow measurement device for identifying a self-sustained influx.

In certain embodiments, referring to FIG. 2A, a flow check line 57 may be coupled between the annular BOP 32 or annular shut-off device 31 and surface fluid reservoir 42. Those skilled in the art will understand that although shown in separate Figures, flow check line 57 and flow control device line 56 (FIG. 1) may be incorporated into the same system, and often are. The flow check line 57 may include a flow control device 59, such as a choke, and a flow rate measurement device 58. Alternatively, the flow check line 57 may include only a flow rate measurement device 58 without including a flow control device, as shown in FIG. 2B. Such fluid flow rate measurement device 58 is preferably a Coriolis flow rate meter, an ultrasonic flow rate meter, a magnetic flow rate meter or a laser-based optical flow rate meter, but may be any suitable type known to those skilled in the art. The flow rate measurement device 58 is arranged and designed to generate a signal $F_{out}(t)$, which is representative of actual annular return flow rate out of the well bore 12 through the flow check line 57 as a function of time (t). The flow rate measurement device 58 transmits the signal $F_{out}(t)$, preferably in real time, to the central control unit 80, which receives and processes the signal.

The flow check line 57 may be coupled with the well casing 16 below the annular shut-off device 31, and thereby be in fluid communication with annular return flow in the borehole annulus 18. Annular shut-off device 31 may be a BOP or also what is called an annular BOP, and may be located anywhere along a length of the well casing 16. The main purpose of the annular shut-off device 31 is to close the borehole annulus 18, thereby converting the open-to-atmosphere system to a closed-to-atmosphere system, and forcing the return fluid from the borehole annulus 18 through a flow control device 59 and a flow rate measurement device 58. Thus, when flow check line 57 is opened by the time the annular shut-off device 31 is closed, fluid from the borehole annulus 18 is permitted to flow up through BOP stack 30, through opened outlet valve 61, through flow check line 57, through flow control device 59 and flow measurement device 58, through mud-gas separator 46, through shale shaker 44, and into surface fluid reservoir 42. Alternatively, on rigs using an annular blowout preventer 32 above the BOP stack 30 for this purpose, existing flow paths may be used (e.g., through the flow control device line 56 and flow control device 70 and flow measurement device 50).

Other configurations may use, for example, an annular preventer, diverter element located at the rig floor, or alternative annular shut off device located above the rig BOP to divert annular return flow to a separate manifold containing the flow control device and flow rate measurement device. In a preferred configuration, for rigs using subsea BOP's, a dedicated annular shut-off device located near the top of the marine riser, but below the rig's telescopic riser slip joint, may be used to divert return flow from a flow outlet below the annular to a dedicated manifold containing the flow control device and flow rate measurement device, with returns subsequently directed to mud/gas separation equipment, overboard lines, or back to the mud system (e.g., via a trip tank or similar).

Flow control device 59 may control flow rate through the flow check line 57, and thus, apply back pressure on the wellbore annulus 18 while annular shut-off device 31 is closed. An outlet pressure measurement device 64, such as a pressure sensor, may be disposed in the flow check line 57 preferably upstream of the flow control device 59. The flow control device 59 may be controlled by software with input from flow rate measurement device 58 downstream of the flow control device 59.

Referring still to FIGS. 1, 2A and 2B, an inlet fluid flow rate measurement device 52, such as a volume or mass flow rate meter is preferably used to measure the fluid flow rate into the well bore 12 while the conventional blow-out preventer 32 or annular shut-off device 31 is closed. The inlet fluid flow rate measurement device 52 is preferably a Coriolis flow rate meter, an ultrasonic flow rate meter, a magnetic flow rate meter or a laser-based optical flow rate meter, but may be any suitable type known to those skilled in the art. Alternatively, even a simple device to measure the strokes of the conventional surface fluid/mud pump 40 as a function of time can serve as an inlet fluid flow rate measurement device. The inlet fluid flow rate measurement device 52 is arranged and designed to generate a signal $F_{in}(t)$, which is representative of actual fluid flow rate through the fluid injection line 48 (i.e., an inlet line coupled between pump 40 and drill string 20) as a function of time (t). The inlet fluid flow rate measurement device 52 transmits the signal $F_{in}(t)$ in real time to the central control unit 80, which receives and processes the signal. The inlet fluid flow rate measurement device 52 is preferably disposed in the fluid injection line 48 between the conventional surface fluid/mud pump 40 and the standpipe manifold (not shown), such that the inlet fluid flow rate measurement device 52 measures fluid flow rate into the borehole 12.

A central control unit 80 is preferably arranged and designed to receive measurement signals from a number of the previously described flow rate measurement devices. The central control unit 80 may use the received signals to generate control signals to control either flow control device 70 or 59 and flow therethrough. The central control unit 80 may then transmit these control signals to the flow control devices 70 or 59, thereby controlling the flow through either flow control device line 56 or flow check line 57. Central control unit 80 may be any type of computing device preferably having a user interface and software 81 installed therein, such as a computer, that is capable of, but not limited to, performing one or more of the following tasks: receiving signals from a variety of measurement devices, converting the received signals to a form exploitable for computing and/or monitoring, using the converted signals for computing and/or monitoring desired parameters, generating signals representative of computed parameters, and transmitting generated signals. With respect to the flow control devices 70 and 59, the central control unit 80 is preferably arranged and designed to transmit generated control signals wirelessly or via a wired link (shown by the dotted lines) to the flow control devices 70 and 59. The control signals received by the flow control devices 70 or 59 from the central control unit 80 cause the orifices of the flow control devices 70 and 59 to either fully open, fully close, or to open or close to some position therein between. While the flow control devices 70 and 59 may be controlled automatically by the central control unit 80 as described above, the flow control devices 70 and 59 may also be manually controlled by an operator to adjust the fluid flow rate or pressure through the flow control devices 70 and 59 at the discretion of the operator.

In certain embodiments, the system may be used in conjunction with advanced well monitoring and/or kick detection software. Such software may utilize actual or calculated downhole drilling parameters received at the central control unit 80 to detect onset of a possible self-sustained influx situation. Whether triggered by influx detection software, conventional instrumentation, routine policy, or a driller's desire to understand suspicious downhole conditions, the driller may perform a flow check procedure to help identify, or rule out, self-sustained influx from a formation. Once the procedure is started, the system may perform a series of programmed steps intended to identify any self-sustained influx, whether or not any other false influx indications exist, as these may be due to other, relatively benign causes (e.g., continued pumping using rig, booster or auxiliary pumps, drillpipe u-tubing, formation ballooning-related flowback, nuisance zone depletion, mud system drain-back, etc.).

Methods 300 related to using any of the systems 10 shown in FIGS. 1, 2A and 2B are now described by reference to FIGS. 3A-3C in accordance with one or more embodiments. Reference numerals that reference the system 10 shown in FIGS. 1, 2A and 2B are indicated in parentheses. Initiating the method may be automatic or not (see process start 301 in FIG. 3A). For example, the method may be automatically initiated without requiring authorization from a driller or operator, such as upon receiving indications of conventional known causes for performing a check for confirming or ruling out the presence of a self-sustained influx. The method may also be manually initiated by an operator, or remotely initiated via computer networks. Initially, the drillstring (20) may be stopped from rotating (see process step 302), and the wellbore annulus is closed using an annular shut-off device (31, 32) (see process step 304). Alternatively, the drillstring may continue rotating even after the wellbore annulus is closed using an annular shut-off device adapted to close around a rotating drillstring. Annular return flow from the wellbore annulus is diverted through a flow rate measurement device (50, 58) in an annular return line (56, 57) (see process step 306).

The inlet flow rate of drilling fluids into the well is measured by a flow rate measurement device (52) (see process step 308), which generates a corresponding signal $F_{in}(t)$ (see data output 310). Likewise, annular return flow rate of fluids returning from well annulus is measured by a flow rate measurement device (50, 58) (see process step 312), which generates a corresponding signal $F_{out}(t)$ (see data output 314). Signals $F_{in}(t)$ and $F_{out}(t)$ may be transmitted to a central control unit (80), where software (81) installed on the central control unit processes the signals (see process step 316). Signals $F_{in}(t)$ and $F_{out}(t)$ may be displayed to a user on a monitor or other display (see data output 318), where the signals may be monitored (see process step 320). The signals are monitored to identify the presence of a self-sustained influx of formation fluids into the wellbore (see logic box 322).

Figure 3A:
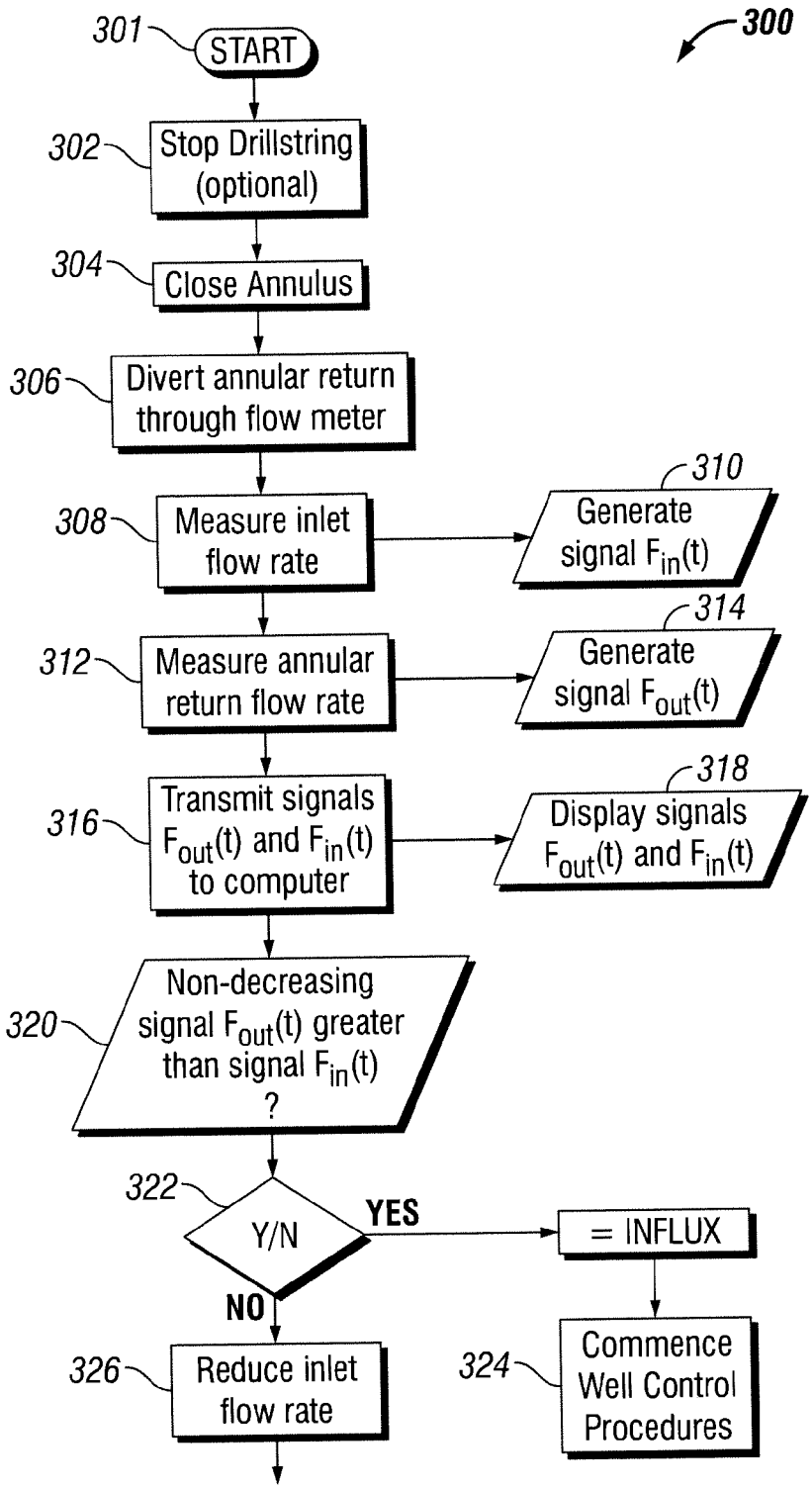
FIGS. 3A-3C illustrate a method of identifying a self-sustained influx using the systems shown in FIGS. 1, 2A and 2B.
Figure 4A:
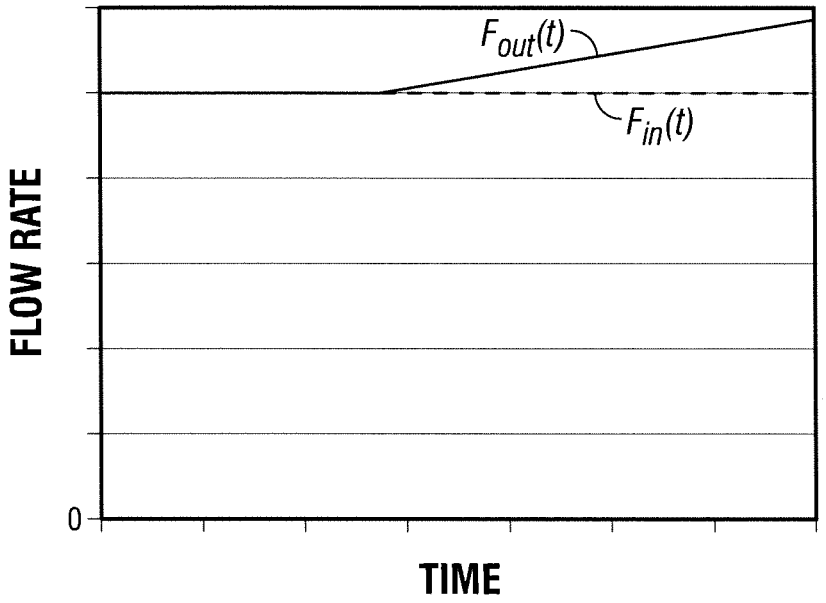
FIGS. 4A and 4B illustrate displays of measured flow in and flow out of a wellbore generated using methods of FIGS. 3A-3C.
Figure 4B:
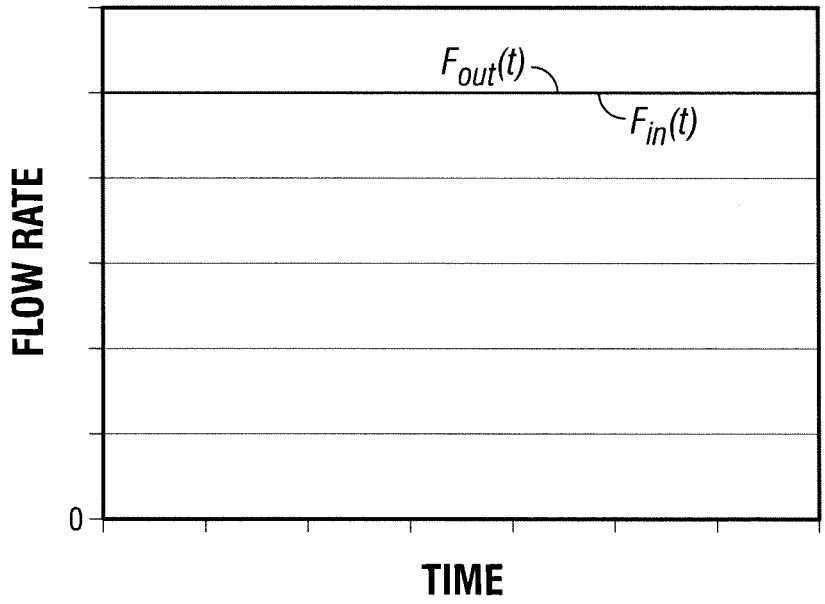

FIGS. 4A and 4B illustrate an example display of signals $F_{in}(t)$ and $F_{out}(t)$ generated (see data output 318 in FIG. 3A). FIG. 4A illustrates a scenario in which a self-sustained influx is identified—a non-decreasing measured annular return flow rate, indicated by signal $F_{out}(t)$, is greater than said measured inlet flow rate indicated by signal $F_{in}(t)$. Upon identifying a self-sustained influx in the wellbore, well control procedures may be commenced (see process step 324 in FIG. 3A). Or, in embodiments including a flow control device (70, 59) in the annular return line, the flow control device may be closed automatically or manually to equalize flow rates of the annular return and inlet flow. FIG. 4B illustrates a scenario in which a self-sustained influx is not immediately confirmed. Here, the annular return flow rate remains substantially the same as the constant inlet flow rate. However, FIG. 4B cannot affirmatively rule out the possibility of a self-sustained influx at a further reduced inlet flow rate or static conditions.

Returning to FIG. 3A, per company policies and procedures, and to more accurately confirm or rule out the presence of a self-sustained influx into the wellbore, the operator may reduce the inlet flow rate of fluids into the wellbore by a certain amount (see process step 326 in FIG. 3A). It will be understood by those skilled in the art that an operator may begin the flow check procedure by immediately reducing the inlet flow rate. To do so, the operator may reduce pump (40) speed. For example, the operator may reduce inlet flow rate by at least 10 gallons per minute ("gpm"), or at least 50 gpm, or at least 100 gpm, and up to 200 gpm, or up to 400 gpm, or up to 600 gpm, or greater. The inlet flow rate of drilling fluids into the well is measured by the flow rate measurement device (52) (see process step 328), which generates a corresponding signal $F_{in}(t)$ (see data output 330). Likewise, annular return flow rate of fluids returning from the well annulus is measured by the flow rate measurement device (50, 58) (see process step 332), which generates a corresponding signal $F_{out}(t)$ (see data output 334). Signals $F_{in}(t)$ and $F_{out}(t)$ may be transmitted to a central control unit (80), where software (81) installed on the central control unit processes the signals (see process step 336). Signals $F_{in}(t)$ and $F_{out}(t)$ may be displayed to a user on a monitor or other display (see data output 338), wherein the signals are monitored (see process step 340). The signals are monitored to identify the presence of a self-sustained influx of formation fluids into the wellbore (see logic box 342).

Figure 3B:
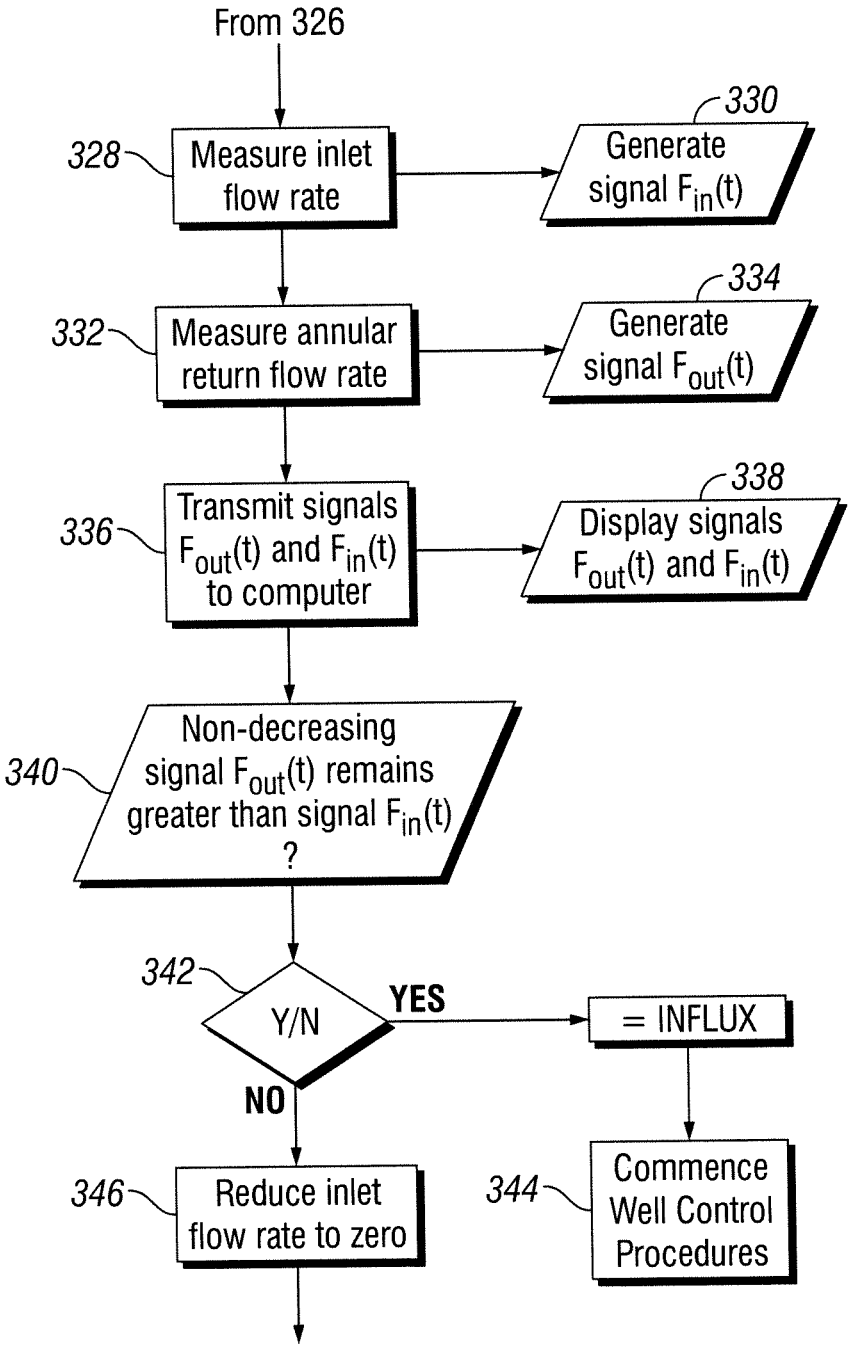
Figure 3C:
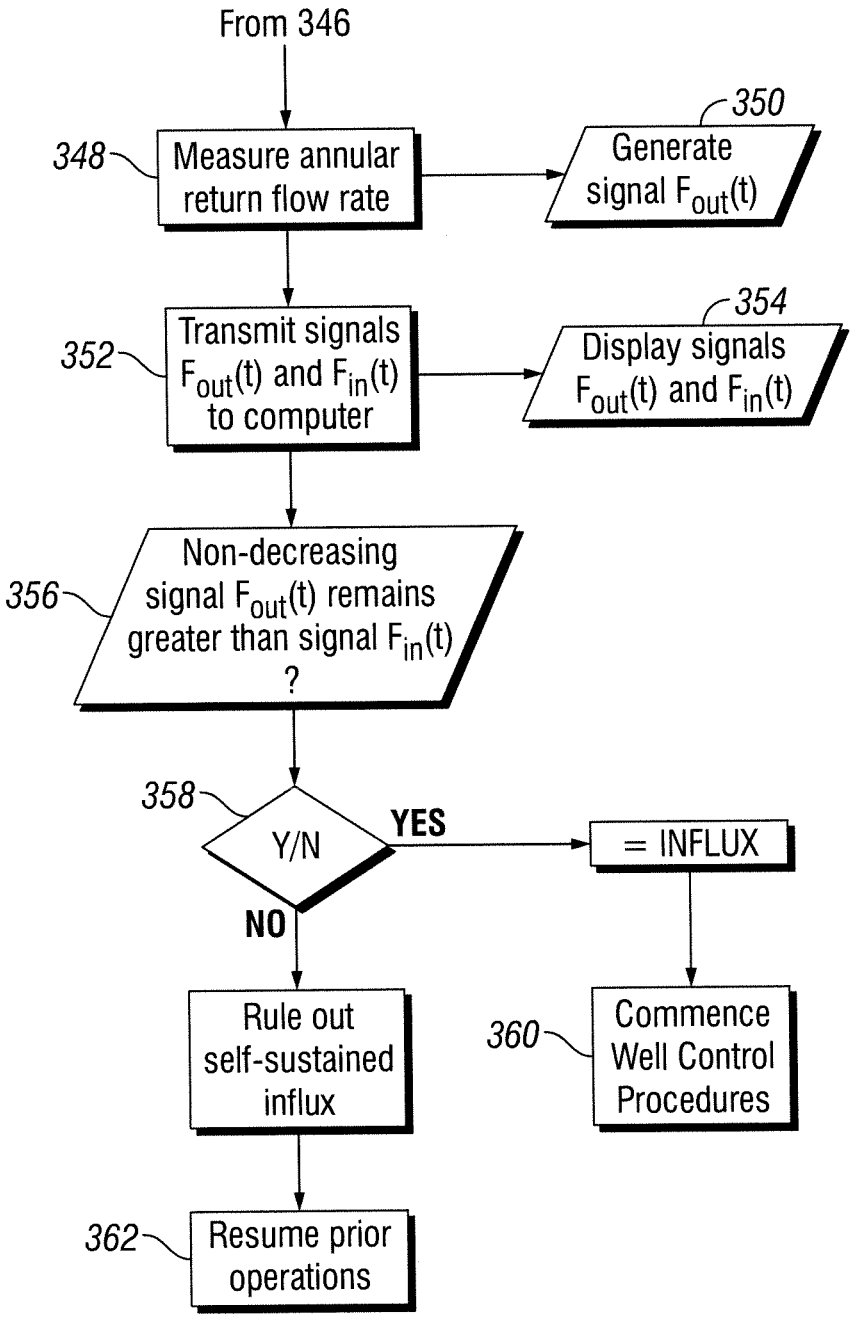
Figure 5A:
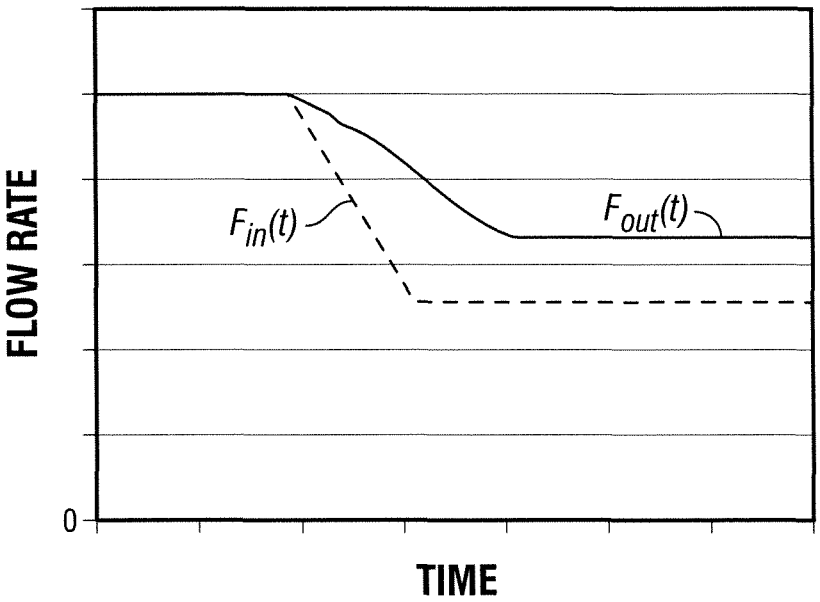
FIGS. 5A and 5B illustrate displays of measured flow in and flow out of a wellbore generated using methods of FIGS. 3A-3C.
Figure 5B:
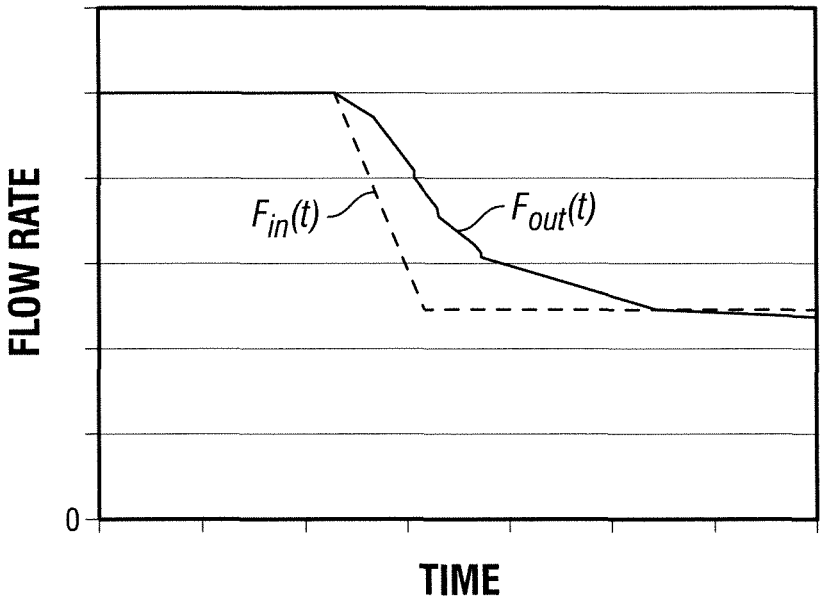

FIGS. 5A and 5B illustrate an example display of signals $F_{in}(t)$ and $F_{out}(t)$ generated (see data output 338 in FIG. 3B). FIG. 5A illustrates a scenario in which a self-sustained influx is identified—a non-decreasing measured annular return flow rate, indicated by signal $F_{out}(t)$, remains greater than said reduced inlet flow rate indicated by signal $F_{in}(t)$. Upon identifying a self-sustained influx in the wellbore, well control procedures may be commenced (see process step 344 in FIG. 3B). Or, in embodiments including a flow control device (70, 59) in the annular return line, the flow control device may closed automatically or manually to equalize flow rates of the annular return and inlet flow. FIG. 5B illustrates a scenario in which a self-sustained influx is not immediately confirmed—after reducing the inlet flow rate, the annular return flow rate decreases to an amount equal to or less than the constant inlet flow rate. However, FIG. 5B cannot affirmatively rule out the possibility of a self-sustained influx at a further reduced inlet flow rate or static conditions.

Returning again to FIG. 3B, per company policies and procedures, and to identify or rule out the presence of a self-sustained influx into the wellbore at further reduced inlet flow rate or static conditions, the operator may reduce the inlet flow rate to substantially zero (see process step 346). It will be understood by those skilled in the art that an operator may begin the flow check procedure by immediately reducing the inlet flow rate to substantially zero. Inlet flow rate is still measured by flow rate measurement device (52) (see process step 328) and annular return flow rate measured by flow rate measurement device (50, 58) (see process step 348). Representative signals $F_{in}(t)$ and $F_{out}(t)$ are generated to indicate inlet flow rate and annular return flow rate, respectively (see data outputs 330 and 350). The signals are transmitted to central control unit (80), where software (81) installed on the central control unit processes the signals (see process step 352). Signals $F_{in}(t)$ and $F_{out}(t)$ may be displayed to a user on a monitor or other display (see data output 354), where the signals may be monitored (see process steps 356). The signals are monitored to either identify or rule out the presence of a self-sustained influx of formation fluids into the wellbore (see logic box 358).

Figure 6A:
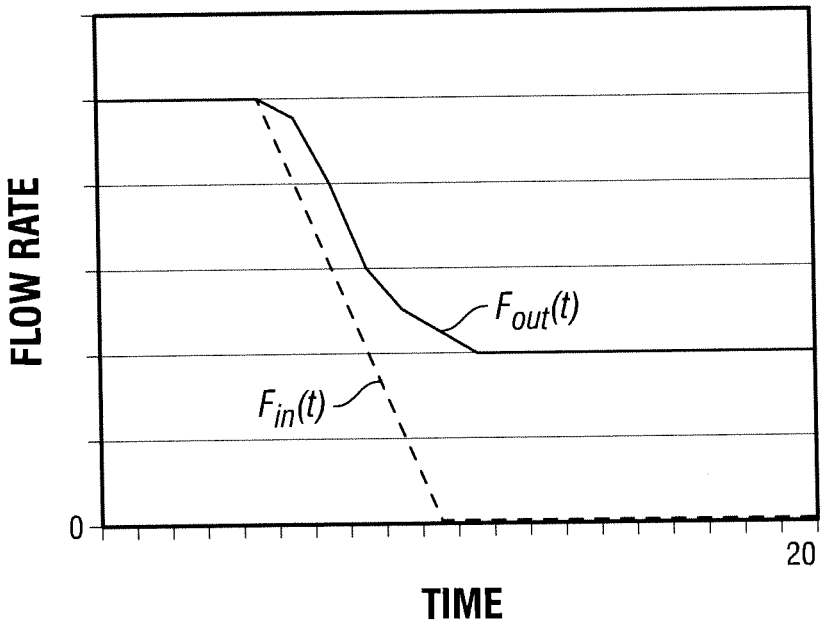
FIGS. 6A and 6B illustrate displays of measured flow in and flow out of a wellbore generated using methods of FIGS. 3A-3C.
Figure 6B:
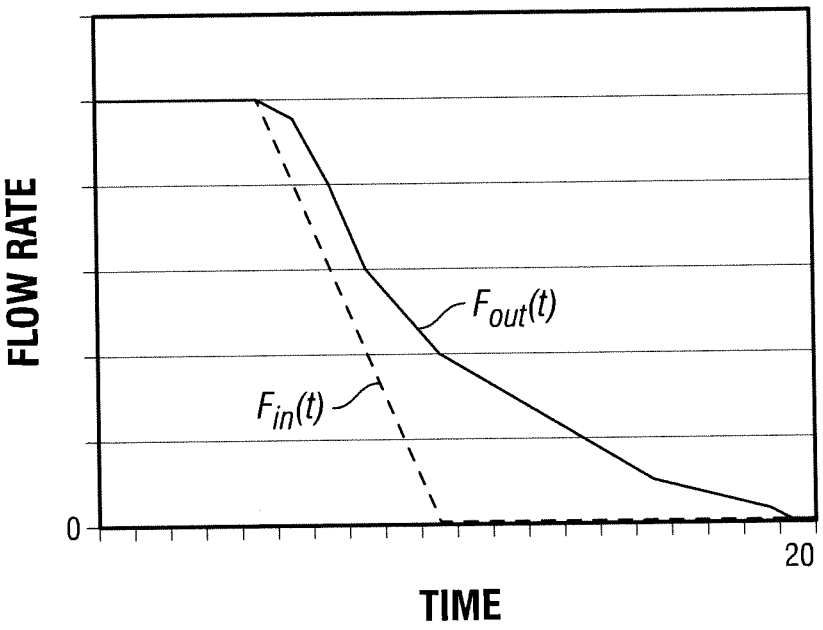

FIGS. 6A and 6B illustrate an example display of signals $F_{in}(t)$ and $F_{out}(t)$ generated (see data output 354). FIG. 6A illustrates a scenario in which a self-sustained influx is identified—a non-decreasing measured annular return flow rate, indicated by signal $F_{out}(t)$, remains greater than said fully reduced inlet flow rate indicated by signal $F_{in}(t)$, which has been reduced to zero. Upon identifying a self-sustained influx, well control procedures may be commenced (see process step 360 in FIG. 3C). Or, in embodiments including a flow control device (70, 59) in the annular return line, the flow control device may be closed automatically or manually to equalize flow rates of the annular return and inlet flow. FIG. 6B illustrates a scenario in which the presence of a self-sustained influx is affirmatively ruled out—the annular return flow rate continues to decrease to substantially zero after the inlet flow rate is reduced to zero. Upon ruling out the presence of a self-sustained influx into the wellbore, prior oil and gas operations in the well may generally be resumed (see process step 362 in FIG. 3C).

In certain embodiments, the system described herein may be activated automatically (if optionally set to be triggered by detection means linked to conventional causes for performing flow check methods described herein, such as specified rate-of-penetration ("ROP") changes, movement of the bit to pre-determined depths during trips, downhole tool output changes, reaching of specific sensor threshold values, etc.) with or without confirming authorization from the driller. System activation may also be triggered, if desired, by use of remote commands via computer networks or triggering devices located, for example, in supervisors' offices.

When activated, the system may be configured to provide messages or instructions to the driller, perhaps based on the specific operation being conducted. For example, if methods described herein while drilling are called for, the system may prompt the driller to stop rotating the drillstring and to lift the drillstring off the bottom of the well to a pre-determined position. Closure of the annular shut-off device may be programmed to occur automatically (one implementation when control of the annulus shut-off device is separate from the rig's BOP controls), or may be accomplished by provision of instruction to the driller as to what action to take to ensure annulus closure and/or system flow path alignment. The system may provide pre-programmed advice to the driller as to whether or not there is need to reduce pump speed to achieve one of several preselected pressure control objectives prior to or during annular shut-off, perhaps including instructions to simply stop relevant pumps.

After the annular flow has been routed through the system, signals received from the flow rate measurement devices may be used to confirm whether or not a self-sustained influx is happening. If the presence of a self-sustained influx is confirmed (by automated flow analysis) and the pumps remain on, the software may optionally be used to automatically close the flow control device until flow out equals flow in (i.e., achieve a "dynamic" shut-in"). Alternatively, the system may be set up to close the flow control device completely in case the pumps are off or are turned off (thereby completing a conventional full shut in against the closed flow control device).

If the system is activated to perform methods described herein with pumps on and self-sustained influx of formation fluids is not confirmed by monitoring flow rates, the system may instruct the driller to subsequently reduce the speed of the pumps, and eventually, completely stop the pumps. The software may look for confirmation of self-sustained influx at all times and if such an influx is confirmed at or after the pumps have stopped, the software may automatically close the flow control device to stop further influx. If flow rate of the annular return flow continues to decrease and reaches zero after the pumps have been turned off, therefore confirming that there is no self-sustained influx, the system may advise that the well is static and the flow check is "negative." For example, the system may display an appropriate signal to a user on a graphical user interface (e.g., "Kick" or "No Kick"). Or for example, the system may display a green signal after ruling out the presence of a self-sustained influx, or display a red signal after confirming the presence of a self-sustained influx. Other indicators and displays may also be used in accordance with one or more embodiments of the system described herein. Drillers may be advised that there is no downhole condition that would preclude immediate return to normal drilling operations (e.g., reopening the annulus, realigning normal return flow paths and resuming the normal drilling activity).

The following related examples are intended to illustrate possible uses of the system and are provided here to clarify typical, though not all, possible usages. While drilling a 12¼" hole at a flow rate of 800 gpm using a rig with a surface BOP and an open-to-atmosphere circulation system, a driller detects a change in drilling parameters that indicate that an influx may be occurring (e.g., a "drilling break"/ROP change, an unexpected slow rise in mud pit volumes, a change in return fluid composition or similar). Recognizing that a possible influx event is occurring or may be about to occur, the driller may wish (or be required by policy) to perform a flow check (e.g., confirming or ruling out the presence of a self-sustained influx of formation fluids into the well).

The driller optionally stops rotating the drillstring and lifts the drillstring off the well bottom to a predetermined position. In certain instances, the driller may slow an inlet flow rate of fluids through the fluid injection line (e.g., by slowing the pump rate) to a specific rate. For example, the pump rate may be calculated by the system to reduce an equivalent circulating density ("ECD") of fluid in the borehole by a calculated amount of friction that will be added when fluid is diverted through the flow check line. In this example, the system may calculate that a flow rate of 475 gpm through the system would cause the ECD at a bottom of the well to be the same as while circulating through an open annulus at 800 gpm, and the driller may be advised to reduce pump speed accordingly before continuing the flow check procedure.

With pump speed reduced to adjust the inlet flow rate to 475 gpm, an annular shut-off device (either a BOP or separate annular shut-off device) may be closed, and an outlet valve on the flow check line leading to the flow rate measurement device may be opened, thereby diverting the 475 gpm annular return flow stream through the open flow rate measurement device and flow control device (if installed on the annular return flow line). The system compares the annular return flow rate measured by the flow rate measurement device in the flow check line with the inlet flow rate measured by the flow rate measurement device in the fluid injection line to confirm, or rule out, the presence of a self-sustained influx of formation fluid into the well (in accordance with method steps described above in reference to FIGS. 3A-3C). In certain embodiments, an annular return flow rate measured by the flow rate measurement device in the flow check line is monitored and observed for a predefined amount of time before any conclusion is made about the absence of a self-sustained influx. For example, the amount of time may be at least 5 seconds, at least 30 seconds, at least 1 minute, and up to about 5 minutes, or up to about 15 minutes, or up to about 30 minutes. Any predefined amount of time may be used. Further, a separate, but different, generally short predefined amount of time (as may be needed for data analysis) may be similarly utilized before presence of a self-sustained influx is identified.

The flow rate measurement device triggers a flow control device to respond to either relative flow rates between annular return flow and inlet flow or a non-decreasing trend of annular return flow, the system may advise the driller that a possible self-sustained influx event has been confirmed and action to temporarily balance net flow has been taken (e.g., the system has moved to perform a "dynamic" shut in if the pumps are on, or has moved to perform a full shut-in if the pumps are already off). The driller may then take the necessary actions to control the well as required, following the company's policies, or known well control procedures. In order to minimize as much as possible the influx volume into the wellbore, the driller may be advised to slowly stop the pump (allowing the system to automatically close the flow control device as needed to keep flow in and flow out in balance) as the initial step of the shut-in, should a dynamic shut in condition be established. Upon ruling out the presence of a self-sustained influx of fluid into the wellbore, the system may display confirmation of such to the driller, and the system may reopen the annular shut-off device and close the flow check line leading to the flow rate measurement and flow control devices (or advise the driller to perform these steps).

Advantageously, using the system in the manner described herein, an unscheduled flow check procedure resulting in clear, recorded documentation of the absence or presence of a self-sustained influx of formation fluid may be routinely completed much faster than using conventional flow check procedures. Another advantage of the system and methods herein described is that confirming a self-sustained influx is achieved with much more certainty than using conventional open-to-atmosphere methods employed today. Currently, the driller may finish a conventional flow check procedure and still be unable to reach a definitive conclusion as to whether a self-sustained influx is or is not occurring. When in doubt, additional procedures are usually conducted to try to reach a conclusion, which requires more time spent. If a self-sustained fluid influx event is confirmed by the methods and system described herein, it may be controlled by the system if a flow control device is implemented on an annular return line, either manually or automatically, permitting simple, straightforward transfer of well control responsibility to the crew using conventional rig BOP and well control equipment.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

The invention claimed is:

1. In a well monitoring system (10) comprising:

an annular shut-off device (31) arranged to close a wellbore annulus (18) of the well (12) from atmosphere;

a flow control device line (56) coupled between said wellbore annulus and a surface fluid reservoir (42), said flow control device line including a flow control device (70);

a fluid injection line (48) in fluid communication with an upper end (24) of a drillstring;

an inlet flow rate measurement device (52) disposed in said fluid injection line, said inlet flow rate measurement device arranged to measure a flow rate in said fluid injection line and to generate a signal $F_{in}(t)$ representative of actual fluid injection line flow rate as a function of time (t);

a flow check line (57) disposed downhole from said annular shut-off device and coupled between said wellbore annulus and said surface fluid reservoir; and an outlet flow rate measurement device (58) disposed in said flow cheek line, said outlet flow rate measurement device arranged to measure flow rate in said flow check line and to generate a signal $F_{out}(t)$ representative of actual flow check line flow rate as a function of time (t), a well monitoring method comprising the steps of, closing said annular shut-off device and diverting an annular return flow from the wellbore through said flow check line and outlet flow rate measurement device;

measuring a flow rate of said annular return flow with said outlet flow rate measurement device;

measuring an inlet flow rate of fluids entering the wellbore with said inlet flow rate measurement device; and upon determining that the measured annular return flow rate is greater than the measured inlet flow rate, identifying the presence of a self-sustained influx of formation fluids based upon a non-decreasing measured annular return.

2. The method of claim 1, further comprising the steps of reducing said inlet flow rate, and, upon determining that the measured annular return flow rate is greater than the measured inlet flow rate, identifying the presence of a self-sustained influx of formation fluids based upon a non-decreasing measured annular return flow rate.

3. The method of claim 2, further comprising the steps of:

fully reducing said inlet flow rate to substantially zero, and, upon determining that the measured annular return flow rate is greater than the measured inlet flow rate, identifying the presence of a self-sustained influx of formation fluids based upon a non-decreasing measured annular return flow rate.

4. The method of claim 3, thither further comprising the step of:

ruling out the presence of a self-sustained influx of formation fluids at existing flow rates based upon a decreasing measured annular return flow rate.

5. The method of claim 4, further comprising the step of reopening the annular shut-off device after ruling out the presence of a self-sustained influx of formation fluids into the wellbore.

6. The method of claim 1, further comprising:

generating a signal $F_{out}(t)$ representative of said annular return flow rate;

generating a signal $F_{in}(t)$ representative of said inlet flow rate; and transmitting said signals $F_{in}(t)$ and $F_{out}(t)$ to a central control unit, which receives said signals $F_{in}(t)$ and $F_{out}(t)$ and computes a delta between said signals $F_{in}(t)$ and $F_{out}(t)$.

7. The method of claim 6, further comprising the step of increasing back pressure on said annular return flow using a flow control device disposed in said flow check line when a self-sustained influx is identified.

8. The method of claim 7, further comprising the step of increasing back pressure on said annular return flow by an amount required to decrease said annular return flow indicated by signal $F_{out}(t)$ to substantially the same as said inlet flow rate indicated by signal $F_{in}(t)$.

9. The method of claim 8, further comprising the step of automatically increasing hack pressure on said annular return flow by said central control unit.

10. The method of claim 1, further comprising the step of stopping rotation of a drillstring (20) or lifting said drillstring of a well bottom.

* * * * *